US005518337A

United States Patent [19]

Modlin

[11] Patent Number: 5,518,337

[45] Date of Patent: May 21, 1996

[54] FLEXIBLE TRAFFIC DELINEATOR AND MOUNTING SYSTEM

[76] Inventor: D. Joe Modlin, 130 Moss Rock Ct., Folsom, Calif. 95827

[21] Appl. No.: 494,140

[22] Filed: Jun. 9, 1995

Related U.S. Application Data

[63] Continuation-in-part of Ser. No. 177,842, Jan. 5, 1994, abandoned, which is a continuation-in-part of Ser. No. 1,040, Jan. 6, 1993, abandoned.

[51] Int. Cl.[6] ..... E01F 9/00

[52] U.S. Cl. ..... 404/10; 404/11; 116/63 R

[58] Field of Search ..... 404/9, 10, 11, 404/12, 13, 14; 40/608, 612; 116/63 R, 63 P; 248/156, 160, 548

[56] References Cited

U.S. PATENT DOCUMENTS

| | | | |
|---|---|---|---|
| 2,949,324 | 8/1960 | Birge et al. | 287/86 X |
| 4,240,766 | 12/1980 | Smith et al. | 404/10 |
| 4,522,530 | 6/1985 | Arthur | 404/10 |
| 4,599,012 | 7/1986 | Kugler et al. | 404/10 |
| 4,636,108 | 1/1987 | Duckett | 404/10 |
| 5,090,348 | 2/1992 | Hugron | 116/63 R |
| 5,197,819 | 3/1993 | Hughes | 404/13 |
| 5,207,175 | 5/1993 | Andonian | 404/10 X |

*Primary Examiner*—Ramon S. Britts
*Assistant Examiner*—James A. Lisehora
*Attorney, Agent, or Firm*—John E. Halamka

[57] ABSTRACT

A traffic delineator has a hollow cylindrical shell which may be of a preselected color over a preselected portion of the cylindrical shell with a wall thickness which is smaller at its top than at its bottom. As a result of the reduced weight at the top of the shell, the delineator has better recovery than delineators with constant wall thickness shells. In addition, the reduced wall thickness requires less material thereby permitting the shell to be made from a higher recovery, higher cost material, such as polyurethane. In one embodiment the wall thickness varies continuously from top to bottom and in another embodiment there is a series of steps with a constant wall thickness section between steps. The delineator has a smaller diameter base which provides rigidity and permits the delineator to be releasably supported by a support stand having a recess which releasably engages the base in a preselected orientation, held therein by a pin. Alternatively, the base can be inserted over and clamped to a soil anchor that has been driven into the ground. An orientation pin is mounted on the soil anchor to keep the delineator in a preselected orientation thereby allowing the color to indicate the preferred direction of traffic being controlled by the delineator.

13 Claims, 2 Drawing Sheets

Fig. 1.
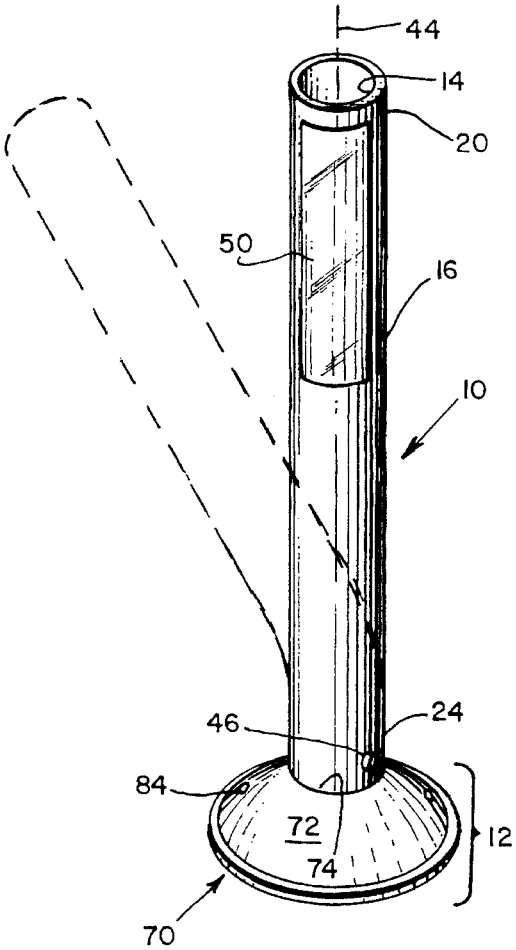
Fig. 2.
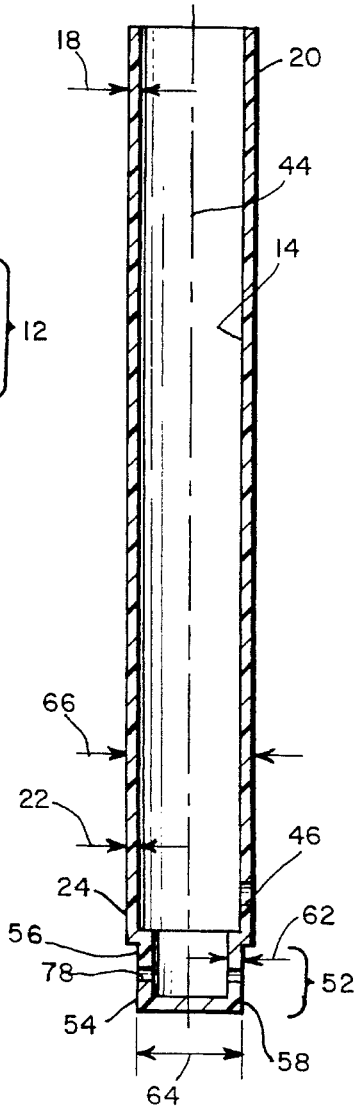
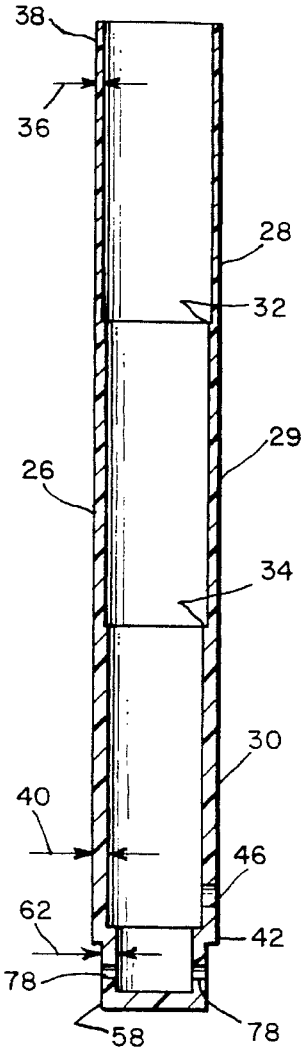
Fig. 3.

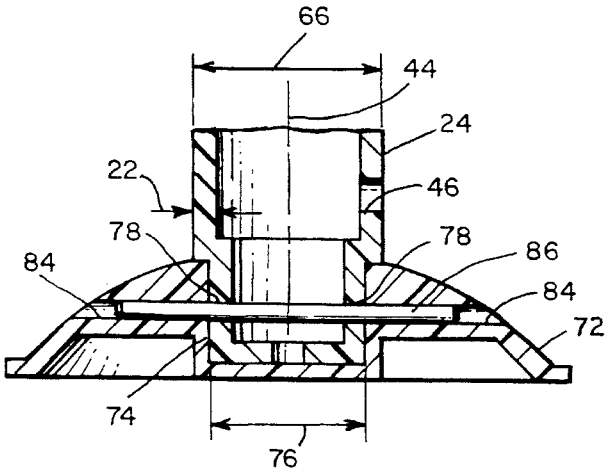
Fig. 4.
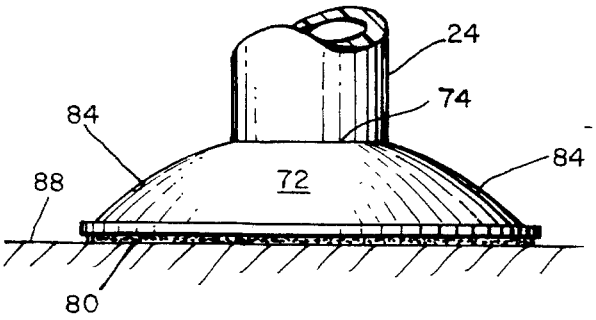
Fig. 5.
Fig. 6.
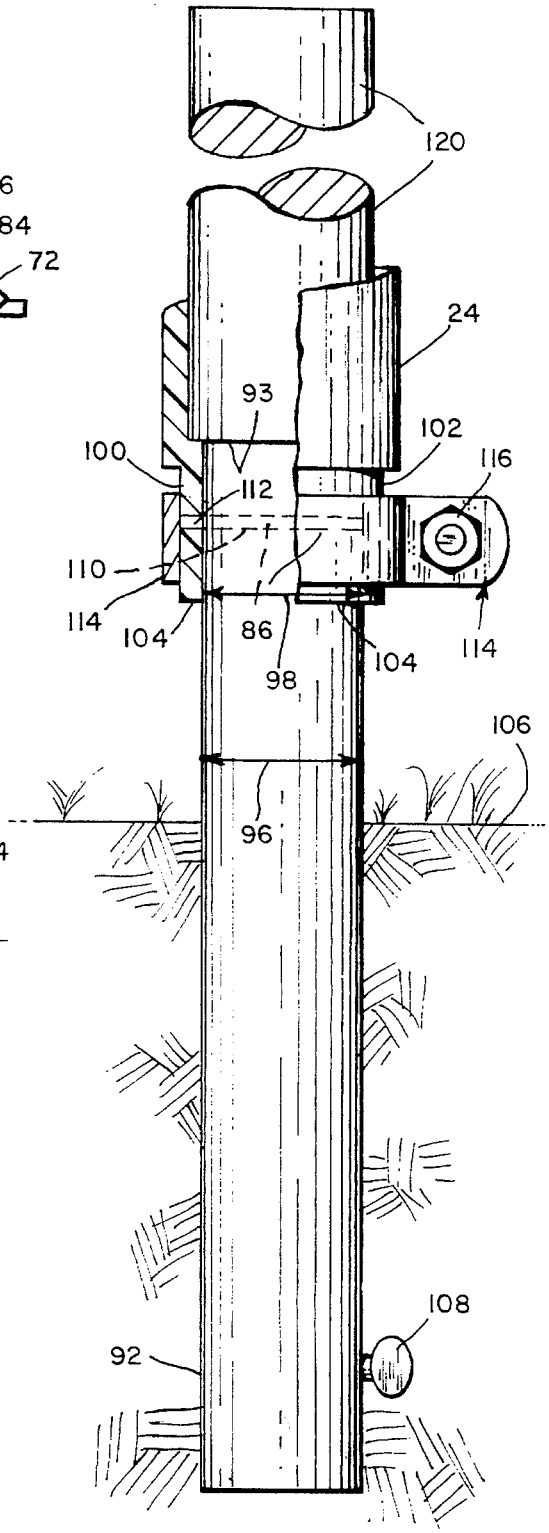

FLEXIBLE TRAFFIC DELINEATOR AND MOUNTING SYSTEM

TECHNICAL FIELD OF THE INVENTION

This is a continuation-in-part of application Ser. No. 08/177,842, filed 5 Jan. 1994, now abandoned which was a continuation-in-part of application Ser. No. 08/001,040 filed Jan. 6, 1993, now abandoned. This invention relates to traffic control devices and more particularly to flexible traffic delineators which may be placed in a specific orientation to provide information to the drivers of vehicles in traffic under control of the devices.

BACKGROUND ART

Traffic delineators mark traffic lanes on roads and highways, serve as object markers indicating traffic obstacles, such as islands, and serve as aids in traffic flow and control in parking lots and garages. Some prior solutions for traffic delineators such as BOTS DOTS are permanently fixed to the pavement. Additional information may be encoded onto such delineators because they are non-rotatable. One edge facing traffic may be color coded yellow to indicate caution. The opposite edge may be color coded red to indicate WRONG WAY especially on a free way. This color coding is especially important direction to drivers when approaching a temporary deviation of traffic, a specific use for the device taught by this invention.

When a traffic delineator is in use, it is not unusual for it to be struck by a vehicle, so it must be capable of being deflected from its normal upright position. In order to remain functional, the traffic delineator must also be able to absorb the vehicle impact and then return to the unflexed position when the impacting force is removed.

Since conventional tubular traffic delineators are made by extrusion, typically from polyvinyl chloride (PVC), they necessarily must have a uniform wall thickness from top to bottom. Such a traffic delineator has a relatively poor memory for recovering from a flexed position to the unflexed position. To assist in recovery, conventional PVC traffic delineators typically have a higher recovery insert, such as a piece of rubber tubing or fiberglass rod, placed in them. In addition, a conventional PVC traffic delineator can typically undergo only ten bend cycles before breaking or failing to recover from the bend, even when a piece of rubber tubing or fiberglass rod is placed in it to help the delineator recover. Although other plastics have better recovery properties than PVC, such as ployurethane, these plastics are also generally more expensive than PVC. Therefore, it has not heretofore been economically feasible to use plastics with better recovery properties in the manufacture of traffic delineators.

Since traffic delineators are regularly destroyed and must be replaced, they need to employ a mounting system that permits quick, simple replacement. However, the conventional traffic delineator mounting systems are cumbersome or expensive. Many mounting systems employ a multiple-part system of threaded components. For example, Duckett, U.S. Pat. No. 4,636,108, discloses a surface mount delineator that is bolted to a mounting plate. the Duckett delineator is not quickly and simply replaceable in its mount.

What is still needed, therefore, is a durable, high recovery traffic delineator that is economically competitive. A need also exists for a delineator mounting system that allows fast, simple attachment or replacement of a traffic delineator. Further needed, is the ability to convey information to the traffic being controlled, in particular information about which direction to travel along the path being delineated.

SUMMARY OF THE INVENTION

The present invention overcomes the drawbacks of the prior art by providing a flexible traffic delineator that is a hollow cylindrical shell having a elongate central axis. The shell wall thickness increases from a minimum at the top of the delineator to a maximum at its bottom, and the shell is flexible in a direction transverse to its central axis. The tapered wall of the traffic delineator reduces the weight at its top thereby causing the delineator to be much more likely to bounce back up after being flexed over than would occur with a straight-walled delineator. Because the tapered wall reduces the required amount of construction material can be utilized to produce a competitively-priced traffic delineator which can withstand 100 bend cycles.

The present invention provides a base for the tubular traffic delineator which has a smaller outside diameter and an equal or larger wall thickness than the delineator shell. Thus, the base is more rigid than the shell. In one embodiment the base is substantially enclosed at its lower extremity which provides even more rigidity. The base is used to removably attach the traffic delineator to a support. The attachment method may be used to provide non-rotatable orientation to the delineator.

The present invention also provides a support for removably receiving the base. The support is a rigid member with a recess having a diameter equal to the diameter of the base. Thus, the base fits releasably in the recess.

The present invention also provides a method of installing a flexible traffic delineator and support. A first end of a rigid cylindrical mounting member is first inserted into the lower end of the hollow tubular base of an elongate, hollow cylindrical shell. the shell is flexible in a direction transverse to its elongate axis in response to an applied force an it returns to an unflexed position upon the removal of the applied force. The base is then fixedly attacked to the mounting member and a driver is inserted into the interior of the hollow shell. The driver is driven to apply force against the first end of the mounting member to drive the mounting member into the soil. Such mounting may be performed at a selected orientation of the delineator.

This method of installing the flexible traffic delineator and support permits pre-assembly of the delineator and support and easy installation of the entire system into the soil. By applying force to the driver rather than directly to the delineator, the delineator does not suffer damage during the installation.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is a perspective view of a flexible traffic delineator and mounting system embodying the present invention.

FIG. 2 is a sectional view of the traffic delineator shown in FIG. 1.

FIG. 3 is a sectional view, similar to FIG. 2, of an alternative embodiment of the traffic delineator of the present invention.

FIG. 4 is a fragmentary sectional view of the flexible traffic delineator and mounting system shown in FIG. 1, at an enlarged scale.

FIG. 5 is a fragmentary side elevational view of the delineator and mounting system shown in FIG. 1.

FIG. 6 is a side elevational view of an alternative embodiment of the mounting system.

DETAILED DESCRIPTION OF THE PREFERRED EMBODIMENT

Referring now to the drawings, a preferred embodiment of a flexible traffic delineator 10 and mounting system 12 is shown in FIG. 1. The delineator 10 includes a hollow cylindrical shell 14 with a wall 16 that increases in thickness from a minimum 18 at the top 20 to a maximum 22 at the bottom 24, as best shown in FIG. 2. The wall thickness at the top of the shell may be less than one-half the wall thickness at the bottom of the shell.

In the embodiment illustrated in FIG. 2, the wall has a thickness that increases continuously from top to bottom, and the shell has a right circular cross section. This shape of shell can best be achieved by injection molding. Preferably, the shell will be molded from a polymer, such as a polyurethane, which will impart the desired strength and flexibility characteristics to the shell.

Alternatively, as shown in FIG. 3, rather than having continuous taper the shell 26 can have multiple sections 28, 29, 30, with each section having a constant wall thickness, which is less than the wall thickness of the downwardly adjacent section. Thus, the wall thickness increases stepwise from a minimum 36 at the top 38 to a maximum 40 at the bottom 42 of the shell 26. In either embodiment the shell can be made in multiple lengths by only using a portion of the mold. For example, traffic delineators having a height of three feet are appropriate for channelizing or marking traffic lanes while shorter lengths may be more appropriate for use in parking lots and garages. With the embodiment shown in FIG. 3, the intersections 32 and 34 between adjacent sections should be located to provide the appropriate intermediate lengths.

As shown in FIG. 1, the shell 14 of the traffic delineator has an elongate central axis 44. A force applied to the traffic delineator, for example, by a vehicle, will cause the delineator to deflect in a direction transverse to this elongate axis, as shown in phantom in FIG. 1. Although not shown in the drawings, this deflection may reach up to 90 degrees. However, due to the shell being thinner at the top than at the bottom, when the applied force is removed the traffic delineator will bounce back to its unflexed position.

The shell 14, 26 of the traffic delineator is preferably not enclosed at its upper end. A hole 46 in the wall proximate the bottom of the shell permits moisture which may enter the top to drain from the shell. the shell can be colored, for example, white, blue, yellow or orange, and reflective tape 50 may also be applied to the shell to make the delineator noticeable. The shell may be multicolored such as red for up to 180° to signify do not travel in this direction and yellow for up to the remaining 180° to signify it is ok to travel in this direction but do so with caution.

The mounting system 12 of the present invention includes a base 52 for the delineator, as best shown in FIGS. 2–4, and a support 70. Once the base 52 is installed in the support 70 the device is non rotatable. The base is a tubular member 54 which is attached at its upper end 56 to the bottom 24 of the shell 14 and 26. the lower end 58 of the base 52 may be substantially enclosed, except for a small central opening 60, to increase the strength and rigidity of the base. The base 52 has a wall thickness 62 at least equal to the maximum wall thickness of the shell. In a preferred embodiment, the base 52 has an outer diameter 64 which is less than the outside diameter 66 of the shell. As a result, the base is more rigid than the shell. The base 52 is preferably made from the same material as the shell and also is formed by injection molding. In a preferred embodiment the base 52 and shell are formed as an integral unit.

Thus, once the base 52 is installed in a support 70, for example as shown in FIGS. 4 and 5, the enclosed end of the base adds increased strength and stability to the system. the traffic delineator is less likely to fracture at the connection between the base and the flexible shell when a transverse force is applied but tends to recover from even extreme flexed positions after the applied force is removed.

The support 70 comprises a rigid mounting member 72 having a central recess 74 with a diameter 76 which is about equal to the diameter 64 of the base, as best shown in FIG. 4. The recess 74 snugly engages the base and has a depth sufficient to receive essentially the entire length of the base.

In a preferred embodiment, the base 52 includes at least one opening 78, which is located transverse the central axis 44. The opening 78 in the base is aligned with an opening 84 in the mounting member 72 when the base is inserted in the recess 74. The user may assemble the device to provide a preselected orientation of the delineator. The aligned openings 78, 84 receive an elongated rigid fastening pin 86 there through, thereby affixing the base to the support in a non-rotatable manner. The orientation may be changed by removal of the rigid fastening pin 86, rotation of the delineator 180° and reinsertion of the pin 86. The fastening pin can be quickly and easily removed, for example by pushing it out of the support with a second pin, when replacement of the delineator is required. The support may be formed in the desired size from a suitable polymer by injection molding.

As shown in FIG. 5, the mounting member 72 is attachable to a traffic-receiving surface 88 in a preselected orientation of a preselected outside surface area of the delineator such as a highway by means of a suitable adhesive 80, such as an epoxy. If a more temporary attachment is required, the support may be weighted down by means of sandbags or the like (not shown).

An alternative embodiment of the support 91 is shown in FIG. 6. Mounting member 92 is a hollow cylindrical soil anchor formed of a rigid material such as steel. The mounting member 92 has an outside diameter 96 about equal to the inside diameter 98 of the tubular member 100 of the base 102. In this case the bottom 104 of the tubular member 100 is not enclosed to permit mounting member 92 to fit within the tubular member 100.

In operation, the mounting member of the soil anchor is inserted into the soil 106 at the desired location. An orientation tab 108 is mounted on the mounting member 92. The tubular member 100 may be attached to the mounting member 92 in a preselected orientation to the orientation tab 108. An orientation tab 108 located on the mounting member 92 prevents rotation of the soil anchor thereby maintaining the preselected orientation of the mounting member 92. If the mounting member 92 is color coded as above, the correct direction of traffic flow is communicated to the traffic being controlled by the delineator. The enclosed bottom end 104 of the base is inserted over mounting member 92. In a preferred embodiment, an opening 110 in the support is aligned with an opening 112 in the base and a pin 86 is inserted there through.

Alternatively, the traffic delineator and support, shown assembled and installed in the soil in FIG. 6, can be assembled prior to installation. the unenclosed bottom end 104 of the base 102 is inserted over a first end 93 of the mounting member 92. An opening 110 in the mounting member proximate the first end is aligned with an opening 112 in the base and a pin 86 is inserted through the aligned openings. An elongate cylindrical driver 120 is inserted into the interior of the hollow cylindrical shell 14. Force is exerted on the driver to apply force against the first end 93 of the mounting member 92 to drive the mounting member into the soil. Such force may be provided by any convenient means such as by striking the top of the driver with a sledge hammer or the like.

In a preferred embodiment, a clamp 114, fastened with a bolt 116 or the like, is secured and tightened around the base 102 to clamp it to the mounting member 92. After installation, the clamp 114 provides extra strength for the base 102, reinforcing the connection between the base 102 and the shell 14 and allowing the shell to return to an unflexed position after the removal of an applied flexing force.

The terms and expressions which have been employed in the forgoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A flexible traffic delineator and mounting system, comprising;

(a) a hollow cylindrical shell having an elongate central axis, a top, a bottom and a wall, said shell being flexible in a direction transverse to its elongate axis in response to an applied force and returning to an unflexed position upon the removal of said applied force and said shell being of a preselected color along a preselected portion;

(b) tubular base which is attached to said bottom of said shell, said base having an outer diameter which is less than the outside diameter of said shell and a wall thickness at least as great as the wall of said shell, said base including and end wall which substantially encloses said lower end thereof, said base further having a wall defining an opening which is located traverse said elongate axis; and (c) a support for removably receiving said tubular base, said support comprising a rigid mounting member defining a recess having a diameter about equal to said outer diameter of said tubular based, said support removably receiving said tubular base within said recess said support further comprising an elongate, rigid fastening pin, wherein said support further defines at least one opening which is also located transverse said elongate axis when said support receives said base, and said openings are alignable to removably receive said fastening pin there through thereby attaching said hollow cylindrical shell in a non-rotatable, preselected orientation to said support whereby the user may mount said traffic delineator in a preselected location thereby indicating the desired direction of flow of traffic by said preselected color.

2. The traffic delineator and mounting system of claim 1 wherein said wall has a thickness which increases from a minimum at said top to a maximum at said bottom.

3. The traffic delineator and mounting system of claim 1 wherein said shell has a right circular cross section.

4. The traffic delineator and mounting system of claim 1 wherein said wall thickness of said shell tapers continuously between said top and said bottom.

5. The traffic delineator and mounting system of claim 1 wherein said wall thickness of said shell increases incrementally in discrete steps between said top and said bottom.

6. A flexible traffic delineator and mounting system, comprising:

(a) a hollow cylindrical shell having an elongate central axis, a top, a bottom and a wall, said shell being flexible in a direction transverse to its elongate axis in response to an applied force and returning to an unflexed position upon the removal of said applied force and said shell being of a preselected color along a preselected portion;

(b) a tubular base which is attached to said bottom of said shell, said base having an outer diameter which is less than the outside diameter of said shell and a wall thickness at least as great as the wall of said shell, said base defining a base recess said base further having a wall defining an opening which is located transverse said elongate axis; and, (c) a support for removably receiving said base, said support comprising a rigid cylindrical mounting member having a diameter about equal to the inner diameter of said tubular base, said support removably receiving said tubular base proximate said base recess, said support further comprising an elongate, rigid fastening pin, wherein said support further defines at least one opening which is also located transverse said elongate axis when said base engages said support and said openings are alignable to removably receive said fastening pin there through thereby attaching said hollow cylindrical shell in a non-rotatable, preselected orientation to said support whereby the user may mount said traffic delineator in a preselected location thereby indicating the desired direction of flow of traffic by said preselected color.

7. The flexible traffic delineator and mounting system of claim 6 wherein said wall has a thickness which increases from a minimum at said top to a maximum at said bottom.

8. The flexible traffic delineator and mounting system of claim 6 wherein said shell has a right circular cross section.

9. The flexible traffic delineator and mounting system of claim 6 wherein said wall thickness of said shell tapers continuously between said top and said bottom.

10. The flexible traffic delineator and mounting system of claim 6 wherein said wall thickness of said shell increases incrementally in discreet steps between said top and said bottom.

11. The flexible traffic delineator and mounting system of claim 6, including a clamp for clamping together said base and said support thereby attaching said hollow cylindrical shell in a non-rotatable, preselected orientation to said support.

12. A method of installing a flexible traffic delineator and support in a preselected orientation, comprising:

(a) providing and elongate, hollow, cylindrical shell which is flexible in a direction transverse to its elongate axis in response to an applied force and returns to an unflexed position upon the removal of said applied force, said shell having a hollow tubular base at the bottom extremity thereof and said shell being of a preselected color along a preselected portion;

(b) inserting a first end of a rigid cylindrical mounting member having an orientation tab mounted thereon into said base;

(c) fixedly attaching said base to said mounting member with said color in a preselected orientation; and (d) inserting a driver into the interior of said hollow shell and driving to apply force against said first end of said mounting member to drive said mounting member into the soil thereby installing said hollow cylindrical shell in a non-rotatable, preselected orientation in a preselected location thereby indicating the desired direction of flow of traffic by said preselected color.

13. The method of claim 12, including the step of clamping together said base and said support in a preselected orientation of said color to said orientation tab.

* * * * *